US007236712B2

(12) United States Patent
Matsuyama

(10) Patent No.: US 7,236,712 B2
(45) Date of Patent: Jun. 26, 2007

(54) IMAGE FORMING APPARATUS AND METHOD FOR ADJUSTING IMAGE FORMING APPARATUS

(75) Inventor: Kengo Matsuyama, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 55 days.

(21) Appl. No.: 11/128,175

(22) Filed: May 13, 2005

(65) Prior Publication Data

US 2006/0013603 A1 Jan. 19, 2006

(30) Foreign Application Priority Data

Jul. 16, 2004 (JP) ..... 2004-210828

(51) Int. Cl.
*G03G 15/00* (2006.01)

(52) U.S. Cl. ..... 399/49; 347/116; 399/301

(58) Field of Classification Search ..... 399/49, 399/72, 301, 394; 347/19, 116; 358/406, 358/504

See application file for complete search history.

(56) References Cited

U.S. PATENT DOCUMENTS 6,295,435 B1 * 9/2001 Shinohara et al. ..... 399/301
7,027,139 B2 * 4/2006 Ogihara et al. ..... 399/49 X
2001/0031148 A1 * 10/2001 Kajiwara et al. ..... 399/49
2004/0208661 A1 * 10/2004 Kitagawa et al. ..... 399/49

FOREIGN PATENT DOCUMENTS

| | | | |
|---|---|---|---|
| JP | 10-31333 | A | 2/1998 |
| JP | 10-213940 | A | 8/1998 |
| JP | 11-249380 | A | 9/1999 |
| JP | 2000-81744 | A | 3/2000 |
| JP | 2003-215883 | A | 7/2003 |

* cited by examiner

*Primary Examiner*—Sophia S. Chen
(74) *Attorney, Agent, or Firm*—Birch, Stewart, Kolasch & Birch, LLP

(57) ABSTRACT

A color test image of each color composed of a plurality of partial images arranged at predetermined intervals in the moving direction of a conveyance belt is formed, at a position on the conveyance belt separated from relative positions where the respective color images are formed by distances according to the respective colors. A detection sensor detects the position of each partial image, and the distance between corresponding partial images in the respective colors is calculated. The distance between the respective color test images by finding an average value of a plurality of partial image distances is calculated, and based on the calculated distance, an adjustment amount for adjusting a position of forming each color image on the medium is calculated so that the respective color images are superimposed on each other without causing color misregistration.

15 Claims, 10 Drawing Sheets

IMAGE FORMING APPARATUS AND METHOD FOR ADJUSTING IMAGE FORMING APPARATUS

CROSS-REFERENCE TO RELATED APPLICATION

This non-provisional application claims priority under 35 U.S.C. §119(a) on Patent Application No. 2004-210828 filed in Japan on Jul. 16, 2004, the entire contents of which are hereby incorporated by reference.

BACKGROUND OF THE INVENTION

1. Field of the Invention

The present invention relates to an image forming apparatus and a method for adjusting an image forming apparatus, for forming a multi-color image by superimposing color images of respective colors and performing a color registration adjustment to correct color misregistration of the multi-color image.

2. Description of Related Art

In an image forming apparatus for forming a multi-color image, after decomposing inputted data into respective color components, namely black (K), cyan (C), magenta (M) and yellow (Y), and performing image processing, image data of the respective color components are created, and a multi-color image is formed by superimposing color images of the respective colors based on the respective image data. When forming a multi-color image, if the positions of the respective color images superimposed deviate from each other, color misregistration occurs in the formed multi-color image and the image quality is lowered. In particular, in a so-called tandem type image forming apparatus comprising an image forming unit for each color component to improve the speed of forming a multi-color image, the respective color images are formed in the respective image forming units separately, and a multi-color image is formed by superimposing the respective color images one after another on a recording medium such as recording paper, or on a transfer medium used for transferring the multi-color image to a recording medium. Therefore, the positions on the transfer medium where the respective color images are formed easily deviate from each other, and consequently such an image forming apparatus has a serious problem that the image quality may be lowered by color misregistration.

Hence, in order to accurately superimpose the respective color images on the transfer medium, an image forming apparatus for forming a multi-color image performs a color registration adjustment for correcting color misregistration of a multi-color image. The conventional color registration adjustment is usually carried out by detecting a deviation of the image forming positions of other color images with respect to the image forming position of one color image to be a reference by an optical detector, determining a correction amount for the image forming position of each color image based on the detection results of the detector so that the image forming positions of the respective color images coincide with each other, and adjusting timings of forming the respective color images according to the determined correction amounts. With such conventional techniques, in order to detect a deviation between the image forming positions of respective color images, the respective color images are formed at predetermined timings, and the distance between the formed respective color images is detected, or the superimposed state and density of a multi-color image formed by superimposing the respective color images are measured.

For example, Japanese Patent Application Laid-Open No. 10-213940 (1998) discloses a technique of detecting a deviation between the positions of respective color images by measuring the distance between the positions on a transfer medium where the respective color images are formed, and correcting the positions of forming the respective color images on the transfer medium, based on the detected positional deviation. In this conventional technique, the distance between a color image to be a reference and other color images is detected with a detector, the amount of deviation of the position of each of the color images is determined based on the detected distance, and a deviation of the positions at which the respective color images are formed is corrected.

Further, Japanese Patent Application Laid-Open No. 2000-81744 discloses a technique in which the density of a multi-color image formed on a transfer medium by superimposing respective color images is measured, and a deviation of the positions at which the respective color images are formed is corrected so that the density of the multi-color image is equal to a density when the respective color images are accurately superimposed. With this conventional technique, in order to improve the correction accuracy, a plurality of line images of the same shape are formed, and the density of the line images formed in many colors is detected with a detector to find the superimposed state of the respective color images. Then, a state in which the detected density of the lines is within a predetermined density range is considered as a state in which the respective color images are accurately superimposed, and the position of forming each color image is corrected so that the respective color images are accurately superimposed.

By the way, in the conventional technique disclosed in the above-mentioned Japanese Patent Application Laid-Open No. 10-213940 (1998), the deviation between the positions of the respective color images is found using the detector for detecting the positions on the medium where the respective color images are formed. In order to accurately detect the deviation between the positions of the respective color images, it is necessary to use a high-resolution detector, and consequently, the cost of the apparatus increases. In this structure, in order to decrease the cost, it is supposed to use a low-resolution detector by forming a plurality of color images of each color and finding an average value of the deviations of the respective color images. However, with a low-resolution detector, among reflection light to be incided on a light receiving unit in the light irradiated from the light emitting unit of the detector, the area of part of light reflected on the image is large, and consequently irregular reflection light also incides the light receiving unit in addition to regular reflection light, and a disturbance occurs in the output of the detector. The disturbance in the output of the detector caused by the irregular reflection light varies depending on various conditions such as the difference in the detection ability of the detector, the mount error of the detector, a temperature change in the image forming apparatus, and changes in the respective components with time, and thus it is difficult to deal with this problem and it is difficult to accurately detect the positional deviation of the respective color images.

On the other hand, in the conventional technique disclosed in Japanese Patent Application Laid-Open No. 2000-81744, for the entire region where a color registration adjustment is performed, it is necessary to find an adjustment amount for the position of each color image by forming test images, including test images in a state in which an image to be a reference and a color image to be subjected to positional adjustment are perfectly superimposed, while changing the superimposed state of the respective color images line by line. Thus, since it is necessary to form test images for color registration adjustment and detect the density for all regions capable of adjusting the positions of the respective color images, there is the problem that the time required for the color registration adjustment becomes longer. Moreover, a large amount of developer is used for the color registration adjustment, and the running cost increases. Further, if the time required for the color registration adjustment is shortened, or if the cost, more specifically the amount of developer necessary for the color registration adjustment is reduced, there arises the problem that the region capable of adjusting the positions of the respective color images becomes narrower.

BRIEF SUMMARY OF THE INVENTION

The present invention has been made with the aim of solving the above problems, and it is a main object of the present invention to provide an image forming apparatus and a method for adjusting an image forming apparatus, which enable accurate adjustment of the positions of respective color images with a simple method capable of shortening the time required for a color registration adjustment and realizing a reduction in the cost, without narrowing a region capable of adjusting the positions of the respective color images.

Another object of the present invention is to provide an image forming apparatus and a method for adjusting an image forming apparatus, capable of highly accurately adjusting the positions of the respective color images by using a low-resolution detector.

An image forming apparatus according to the present invention is comprises: a plurality of image forming means for forming color images of mutually different colors on a medium which is moving in a predetermined direction; test image forming means for causing each of the plurality of image forming means to form a test image on the medium; irradiating means for irradiating light to the test image formed on the medium; detecting means for detecting regular reflection light and irregular reflection light of the light irradiated to the test image by the irradiating means; and adjusting means for adjusting, based on detection results of the detecting means, a position of forming a color image on the medium by each of the image forming means so that the color images formed by the respective image forming means are exactly superimposed on each other, and is characterized in that the test image forming means causes each of the image forming means to form a color test image composed of a plurality of partial images arranged at predetermined intervals in the moving direction of the medium, at a position on the medium separated from relative positions on the medium where the respective color images are formed by distances according to the respective colors, and the adjusting means includes: partial image distance calculating means for calculating, based on detection results of the detecting means, a partial image distance that is a distance between mutually corresponding partial images in the respective color test images formed on the medium; color image distance calculating means for calculating, based on the calculation result of the partial image distance calculating means, a color image distance that is a distance between the respective color test images formed on the medium; and adjustment amount calculating means for calculating, based on the color image distance calculated by the color image distance calculating means, an adjustment amount for adjusting a position of forming a color image on the medium by each of the image forming means so that the color images formed by the respective color image forming means are exactly superimposed on each other.

Note that the detecting means may be constructed to detect regular reflection light and irregular reflection light from substantially the same portion of the test image at substantially the same time.

Further, the detecting means may be constructed to detect regular reflection light and irregular reflection light caused by the same light irradiated to the test image by the irradiating means.

An image forming apparatus according to the present invention is, in the above mentioned image forming apparatus, characterized in that the detecting means includes: regular reflection light detecting means for detecting regular reflection light including irregular reflection light; and irregular reflection light detecting means for detecting irregular reflection light, the adjusting means includes: means for calculating a difference between a detection result detected by the regular reflection light detecting means and a detection result detected by the irregular reflection light detecting means; and partial image position specifying means for specifying a position of each partial image included in each color test image formed on the medium, based on a change in the difference value calculated by the means; and the partial image distance calculating means calculates the partial image distance, based on the positions of the partial images specified by the partial image position specifying means.

An image forming apparatus according to the present invention is, in the above mentioned image forming apparatus, characterized in that the regular reflection light detecting means and the irregular reflection light detecting means are constructed as one unit.

An image forming apparatus according to the present invention is, in the above mentioned image forming apparatus, characterized in that the test image forming means includes means for causing each of the image forming means to form vertical line images that are line images substantially orthogonal to the moving direction of the medium as the partial images, and the adjustment amount calculating means includes means for calculating, based on the color image distance when the partial images are the vertical line images, an adjustment amount for adjusting a position of forming a color image on the medium by each of the image forming means in the moving direction of the medium.

An image forming apparatus according to the present invention is, in the above mentioned image forming apparatus, characterized in that the test image forming means further includes means for causing each of the image forming means to form oblique line images that are line images oblique to the moving direction of the medium as the partial images, and the adjustment amount calculating means further includes means for calculating, based on the color image distance when the partial images are the oblique line images and the vertical line images, an adjustment amount for adjusting a position of forming a color image on the medium by each of the image forming means in a direction substantially orthogonal to the moving direction of the medium.

A method for adjusting an image forming apparatus according to the present invention is a method for an image forming apparatus which includes: a plurality of image forming means for forming color images of mutually different colors on a medium being moving in a predetermined direction; test image forming means for causing each of the plurality of image forming means to form a test image on the medium; irradiating means for irradiating light to the test image formed on the medium; and detecting means for detecting regular reflection light and irregular reflection light of the light irradiated to the test image by the irradiating means so that the color images formed by the respective image forming means are exactly superimposed on each other, characterized by comprising the steps of: causing each of the image forming means, by controlling of the test image forming means, to form a color test image composed of a plurality of partial images arranged at predetermined intervals in the moving direction of the medium, at a position on the medium separated from relative positions on the medium where the respective color images are formed by distances according to the respective colors; calculating, based on detection results of the detecting means, a partial image distance that is a distance between mutually corresponding partial images in the respective color test images formed on the medium; calculating, based on the calculated partial image distances, a color image distance that is a distance between the respective color test images formed on the medium; and calculating, based on the calculated color image distance, an adjustment amount for adjusting a position of forming a color image on the medium by each of the image forming means so that the color images formed by the respective color image forming means are exactly superimposed on each other.

In such invention, the image forming apparatus comprising a plurality of image forming means for forming color images of mutually different colors on a moving medium forms, as a test image, color test images of respective colors, each composed of a plurality of partial images arranged at predetermined intervals in a moving direction of the medium, at positions on the medium separated from relative positions on the medium where the respective color images are formed by distances according to the respective colors; detects the test image on the medium by detecting means using light; calculates the distance between mutually corresponding partial images included in the respective color test images; calculates the distance between the respective color test images based on the distance between the partial images; and calculates an adjustment amount for adjusting a position of forming a color image on the medium so that the color images formed by the respective color image forming means are exactly superimposed on each other.

According to the present invention, since the method for calculating the distance between the respective color test images by detecting the color test images formed at positions separated from positions where the respective color images are formed by distances according to the respective colors to perform color registration adjustment is a simple method compared to a method in which color test images are formed one upon another and then the superimposed state is measured, it is possible to reduce the time taken for the color registration adjustment without narrowing the region capable of adjusting the positions of the respective color images. Moreover, in order to find the distance between the separated color test images, there is no need to form the respective color test images one upon another and it is sufficient to form the respective color test images with a minimum amount of developer, and therefore it is possible to reduce the cost of the color registration adjustment without narrowing the region capable of adjusting the positions of the respective color images. Additionally, by finding the distance between the respective color test images by using a plurality of partial image distances, it is possible to accurately calculate an adjustment amount for adjusting a position of forming a color image on the medium.

In the above-described invention, if the detecting means for detecting a test image is constructed to simultaneously detect regular reflection light and irregular reflection light of light irradiated to the same portion of the test image formed on the medium, since there is no difference in the detection time and position, it is possible to highly accurately detect regular reflection light and irregular reflection light under a uniform condition compared to a structure in which regular reflection light and irregular reflection light from the same portion of the test image are not detected simultaneously.

Further, in the above-described invention, if the detecting means for detecting a test image is constructed to detect regular reflection light and irregular reflection light caused by the same irradiated light, the detecting means is not influenced by the difference in the light emitting characteristics of the irradiating means, and it is possible to perform more accurate detection compared to the structure in which the detecting means detects reflection light caused by different irradiated light.

In addition, in the present invention, the detecting means comprises regular reflection light detecting means for detecting regular reflection light including irregular reflection light, and irregular reflection light detecting means for detecting irregular reflection light; specifies the position of each partial image based on the difference between a detection result of the regular reflection light detecting means and a detection result of the irregular reflection light detecting means; and calculates a partial image distance based on the specified positions of the respective partial images.

According to such invention, when a K-color image is detected, the detection result of regular reflection light changes significantly, while when each of C-, M-, and Y-color images is detected, the detection result of irregular reflection light changes significantly, and therefore it is possible to highly accurately specify the position of each partial image, based on a change in the value of difference between the detection result of regular reflection light and the detection result of irregular reflection light. Further, by subtracting the detection result of irregular reflection light from the detection result of regular reflection light, it is possible to eliminate the disturbance in the detection result of regular reflection light caused by the irregular reflection light mixed with the regular reflection light. Hence, even when low-resolution detecting means is used, it is possible to calculate an adjustment amount for accurately adjusting a position of forming a color image on the medium.

Moreover, in the present invention, the regular reflection light detecting means and the irregular reflection light detecting means are constructed as one unit.

According to such invention, it is possible to detect regular reflection light and irregular reflection light under a uniform condition without being influenced by an error in the mount positions of the regular reflection light detecting means and the irregular reflection light detecting means, or moving irregularly of the medium, etc. as compared to the case where the regular reflection light detecting means and the irregular reflection light detecting means are constructed as separate units.

In the present invention, vertical line images are formed as the partial images, a color image distance based on the distance between the vertical line images of the respective color test images is calculated, and an adjustment amount for adjusting a position of forming a color image on the medium in a sub-scanning direction is calculated based on the calculated color image distance.

According to such invention, it is possible to easily find an adjustment amount in the sub-scanning direction to adjust a position of forming a color image on the medium.

Further, in the present invention, oblique line images oblique to the moving direction of the medium are formed as the partial images, a color image distance based on the distance between the oblique line images of the respective color test images is calculated, and an adjustment amount for adjusting a position of forming a color image on the medium in a main scanning direction is calculated based on the calculated color image distance.

According to such invention, by forming oblique line images as partial images and calculating the color image distance of oblique lines between the respective colors, it is possible to easily find an adjustment amount in the main scanning direction to adjust a position of forming a color image on the medium.

The above and further objects and features of the invention will more fully be apparent from the following detailed description with accompanying drawings.

DETAILED DESCRIPTION OF THE PREFERRED EMBODIMENTS

The following description will specifically explain the present invention, based on the drawings illustrating an embodiment thereof.

Figure 1:
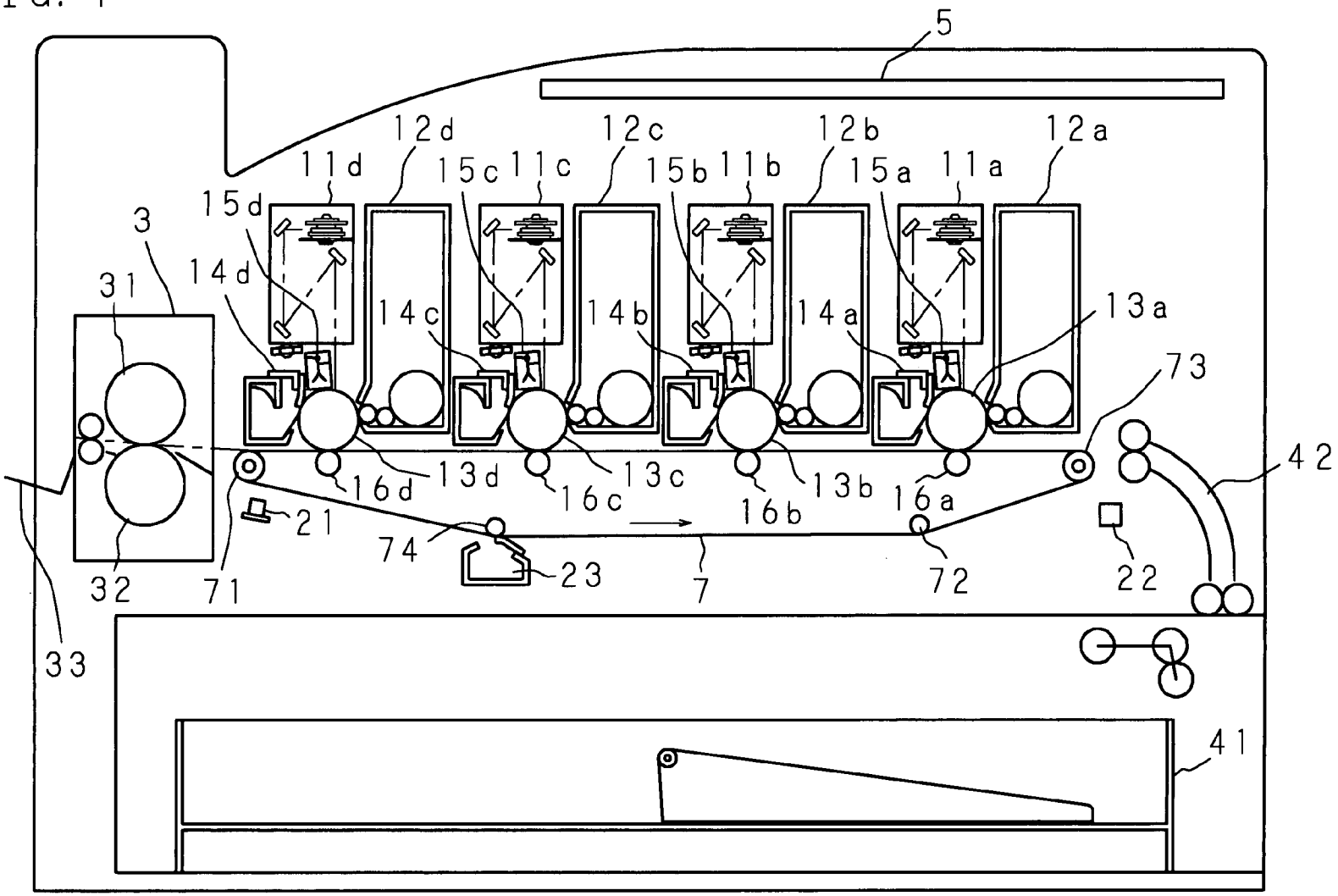
FIG. 1 is a schematic vertical sectional view showing an example of the internal structure of an image forming apparatus of the present invention.

FIG. 1 is a schematic vertical sectional view showing an example of the internal structure of an image forming apparatus of the present invention. The image forming apparatus shown in FIG. 1 employs a direct transfer system in which an image is directly transferred to recording paper as a recording medium. The image forming apparatus is constructed to form a multi-color image by using toners of respective colors, namely, black (K), cyan (C), magenta (M) and yellow (Y). The image forming apparatus comprises exposure units 11*a*, 11*b*, 11*c*, 11*d*; developing devices 12*a*, 12*b*, 12*c*, 12*d*; photoconductor drums 13*a*, 13*b*, 13*c*, 13*d*; cleaner units 14*a*, 14*b*, 14*c*, 14*d*; and charging devices 15*a*, 15*b*, 15*c*, 15*d*. The alphabets "a", "b", "c" and "d" added to the respective numbers correspond to the respective colors, namely, K, C, M, and Y, respectively. One set of exposure unit, developing device, photoconductor drum, cleaner unit and charging device is provided for each color, and four sets corresponding to K, C, M, and Y are arranged in a straight line. Besides, a set of exposure unit, developing device, photoconductor drum, cleaner unit and charging device for each color corresponds to an image forming unit according to the present invention. In the following description, these members are merely recited as the exposure unit 11, the developing device 12, the photoconductor drum 13, the cleaner unit 14, and the charging device 15, except for the case where a member corresponding to a specific color needs to be specified.

The exposure unit 11 may be constructed by a write head composed of light emitting elements such as EL and LED arranged in an array, or a laser scanning unit (LSU) comprising a laser irradiating unit and a reflective mirror. In the example shown in FIG. 1, the LSU is used. By performing exposure according to the inputted image data, the exposure unit 11 forms an electrostatic latent image corresponding to the image data on the photoconductor drum 13.

The charging device 15 uniformly charges the surface of the photoconductor drum 13 to a predetermined electric potential. As the charging device 15, it may be possible to use a charger type charging device which does not come into contact with the photoconductor drum 13 as well as a roller or brush type charging device which comes into contact with the photoconductor drum 13. The developing devices 12 store toners of respective colors, and develop the electrostatic latent images formed on the photoconductor drums 13 into visible images by supplying the toners of the respective colors. The cleaner unit 14 removes and collects the toner remaining on the photoconductor drum 13 after transferring the image to recording paper.

The image forming apparatus also comprises, under the photoconductor drums 13, a conveyance belt 7 for conveying the recording paper. The conveyance belt 7 is formed as an endless belt with a thickness of around 100 μm by using polycarbonate, polyimide, polyamide, polyvinylidene fluoride, polytetrafluoroethylene copolymer, or ethylene tetrafluoroethylene copolymer. The conveyance belt 7 is stretched around a belt driving roller 71, a belt tension roller 73 and conveyance belt driven rollers 72, 74, and is moved in the direction of an arrow shown in FIG. 1 by a drive force of the belt driving roller 71. The conveyance belt 7 is arranged so that its surface is in contact with the photoconductor drums 13. Further, transfer rollers 16*a*, 16*b*, 16*c* and 16*d* are provided to face the photoconductor drums 13*a*, 13*b*, 13*c* and 13*d*, respectively, with the conveyance belt 7 between them. Unless otherwise necessary, the transfer rollers 16*a*, 16*b*, 16*c*, 16*d* corresponding to the respective colors will be hereinafter collectively referred to as the transfer rollers 16.

The image forming apparatus also comprises a paper feed tray 41 for storing recording paper, and a conveyance path for conveying the recording paper from the paper feed tray 41 to the conveyance belt 7. The recording paper stored in the paper feed tray 41 is conveyed to the conveyance belt 7 through the conveyance path 42, absorbed to the conveyance belt 7, and further conveyed in contact with the photoconductor drums 13. The transfer roller 16 is in contact with the back side of the conveyance belt 7 and is able to uniformly apply to the conveyance belt 7 a high voltage of the polarity opposite to the charged polarity of the toner. By uniformly applying a high voltage to the conveyance belt 7 by the transfer roller 16, the toner image on the photoconductor drum 13 is transferred to the recording paper being absorbed to and conveyed by the conveyance belt 7. By transferring the toner image to the recording paper in this manner, respective color images of K, C, M, and Y are formed one after another on the recording paper, and finally a multi-color image is formed on the recording paper.

The image forming apparatus further comprises a fixing unit 3 having a heat roller 31 and a pressure roller 32, and a paper discharge tray 33. The recording paper on which the multi-color image is formed is conveyed to the fixing unit 3 by the conveyance belt 7. The heat roller 31 and the pressure roller 32 rotate while holding the recording paper on which the multi-color image is formed between them. The multi-color image formed on the recording paper is melted with the heat of the heat roller 31 once and then sticks to the recording paper, and consequently the multi-color image is fixed. The recording paper on which the multi-color image is fixed is discharged to the paper discharge tray 33.

In-the above-described process of forming a multi-color image on recording paper, positions on the recording paper where the respective color images are formed are determined by the timings at which the toner images of respective colors are transferred from the photosensitive drums 13*a*, 13*b*, 13*c* and 13*d* to the recording paper being conveyed on the conveyance belt 7. The image forming apparatus comprises a control unit 5 for controlling the timing of transferring the toner image of each color to the recording paper. The control unit 5 is constructed to control the transfer timings so that the respective color images are exactly superimposed on the recording paper. However, due to various causes such as a mount error, eccentricity and rotational irregularity of the photoreceptor drums 13, shrinkage or expansion and moving irregularity of the conveyance belt 7 caused by a change in temperature and/or humidity, the positions of the respective color images formed on the recording paper may deviate from each other, and color misregistration may occur.

On the conveyance belt 7 that is a medium according to the present invention, the image forming apparatus of the present invention forms a test image in which images of respective colors are separated from each other by a predetermined distance; measures the actual distance between the respective color test images included in the test image; and performs a color registration adjustment process for adjusting the timings of transferring the respective color images to the recording paper. The image forming apparatus further comprises a detection sensor 21 for detecting the test image formed on the conveyance belt 7, a temperature and humidity sensor 22 for detecting the temperature and humidity within the image forming apparatus, and a belt cleaning unit 23 for removing the toner adhering to the conveyance belt 7.

The belt cleaning unit 23 removes and collects the toners of respective colors forming the test image transferred directly to the conveyance belt 7, or the toner adhering to the conveyance belt 7 due to contact with the photoconductor drums 13. In order to detect the test image formed on the conveyance belt 7, the detection sensor 21 is disposed at a position where the conveyance belt 7 has passed through the photoconductor drums 13*a*, 13*b*, 13*c* and 13*d* but does not reach the belt cleaning unit 23. The temperature and humidity sensor 22 is disposed in a portion where an abrupt change in temperature or humidity does not occur locally, and detects the temperature and humidity within the image forming apparatus.

Figure 2:
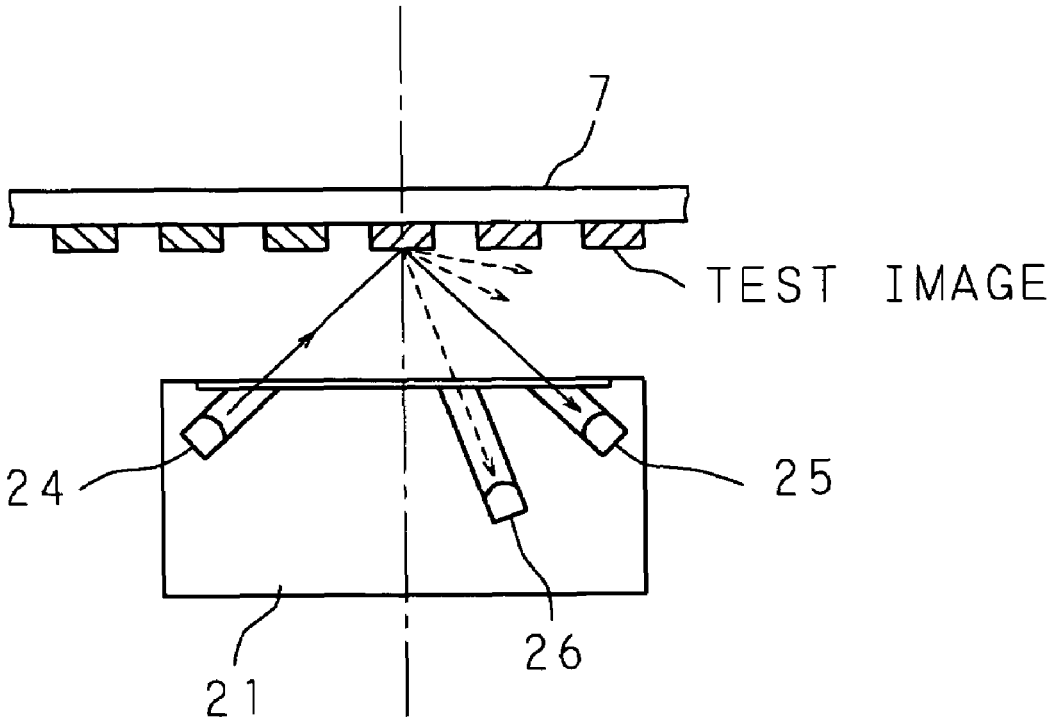
FIG. 2 is a schematic view showing an example of the structure of a detection sensor of the image forming apparatus of the present invention.

FIG. 2 is a schematic view showing an example of the structure of the detection sensor 21. The detection sensor 21 comprises an irradiating unit 24 for irradiating light to the test image formed on the conveyance belt 7. Moreover, the detection sensor 21 comprises a regular reflection light detecting unit 25 at a position capable of detecting regular reflection light caused by irradiating light to the test image from the irradiating unit 24. Further, the detection sensor 21 comprises an irregular reflection light detecting unit 26 at a position capable of detecting irregular reflection light from the test image but not capable of detecting regular reflection light caused by irradiating light to the test image from the irradiating unit 24. In FIG. 2, the regular reflection light is indicated by the solid line, and the irregular reflection light is indicated by the broken line. The irregular reflection light detecting unit 26 detects only irregular reflection light, but the regular reflection light detecting unit 25 detects regular reflection light including irregular reflection light because part of irregular reflection light also incides the regular reflection light detecting unit 25. The regular reflection light detecting unit 25 and the irregular reflection light detecting unit 26 are constructed to detect regular reflection light and irregular reflection light from substantially the same portion of the test image at substantially the same time.

By the way, although FIG. 2 shows the detection sensor 21 comprising one irradiating unit 24, one regular reflection light detecting unit 25 and one irregular reflection light detecting unit 26 as one unit, the structure of the detecting unit 21 is not limited to this. It is not necessarily to construct the regular reflection light detecting unit 25 and irregular reflection light detecting unit 26 as one unit, and they may be provided as separate units. However, as shown in FIG. 2, if the regular reflection light detecting unit 25 and the irregular reflection light detecting unit 26 are constructed as one unit, it is possible to detect regular reflection light and irregular reflection light under a uniform condition without being influenced by setting error of the regular reflection light detecting unit 25 and the irregular reflection light detecting unit 26, or moving irregularly of the conveyance belt 7, etc. as compared to the case where the regular reflection light detecting unit 25 and the irregular reflection light detecting unit 26 are provided as separate units.

Alternatively, the detection sensor 21 may comprise a plurality of irradiating units 24, and the regular reflection light detecting unit 25 and the irregular reflection light detecting unit 26 may detect mutually different reflection light caused by the light irradiated from different irradiating units 24. However, in the structure in which the regular reflection light detecting unit 25 and the irregular reflection light detecting unit 26 detect reflection light caused by the same irradiated light as shown in FIG. 2, since the detection sensor 21 is not influenced by the difference in the light emitting characteristics of the plurality of irradiating units 24, it is possible to perform more accurate detection compared to the structure in which the regular reflection light detecting unit 25 and the irregular reflection light detecting unit 26 detect reflection light caused by mutually different irradiated light.

Alternatively, the detection sensor 21 may comprise one irradiating unit for regular reflection light, one irradiating unit for irregular reflection light, and one detecting unit, and may be constructed so as not to detect the same portion of the test image simultaneously, such as a structure in which regular reflection light and irregular reflection light are detected by one detecting unit by changing the light emission timings of the two irradiating units. In such a structure, however, it is necessary to correct the time difference between the light emission timings of the two irradiating units, and there may be a difference in the position of the detected portion. Therefore, the structure in which regular reflection light and irregular reflection light from the same portion of the test image are detected simultaneously as shown in FIG. 2 can more exactly detect regular reflection light and irregular reflection light under a uniform condition compared to the structure in which regular reflection light and irregular reflection light from the same portion of the test image are not detected simultaneously.

Figure 3:
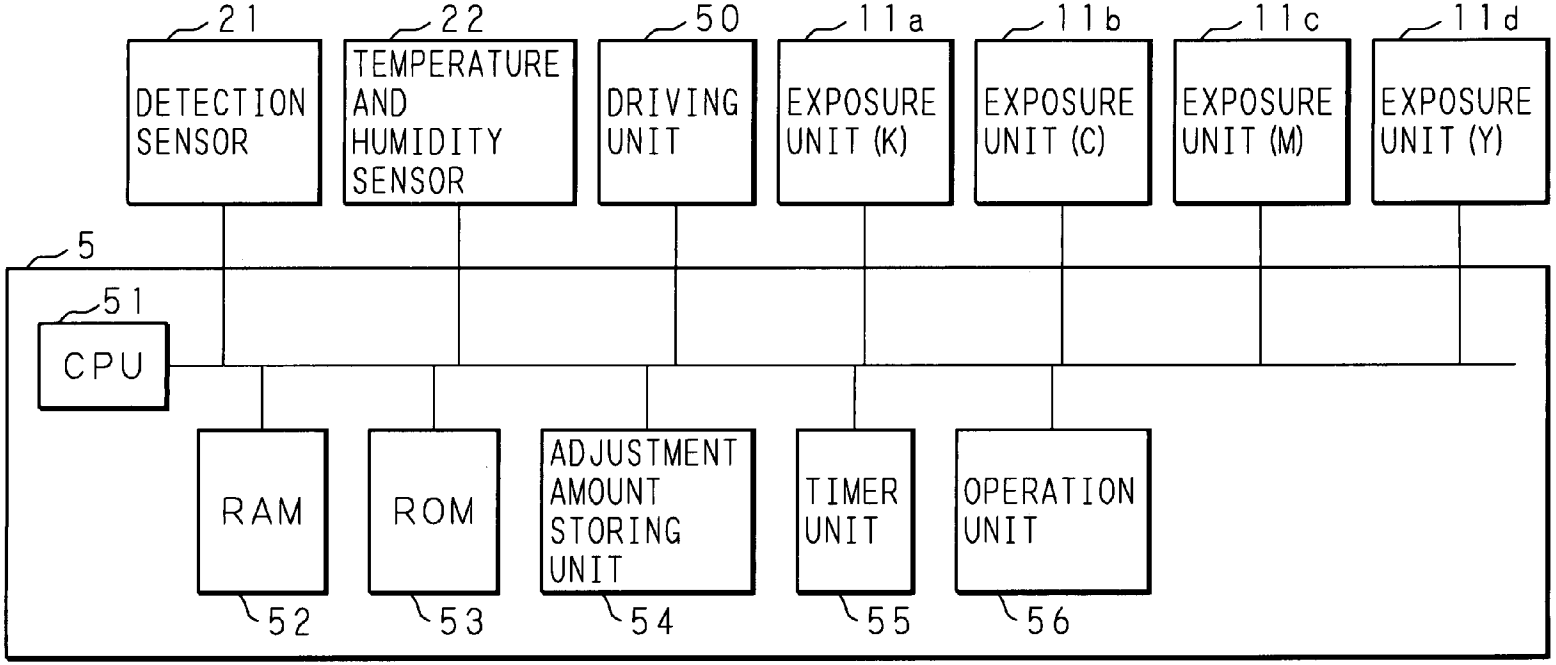
FIG. 3 is a block diagram showing an example of the internal structure of a control unit of the image forming apparatus of the present invention.

FIG. 3 is a block diagram showing an example of the internal structure of the control unit 5. The control unit 5 comprises a CPU 51 for performing processing, which is connected with a RAM 52 for storing temporary information generated by processing, and a ROM 53 storing a control program for controlling the image forming apparatus. The CPU 51 performs processing necessary for the image forming apparatus, according to the control program stored in the ROM 53. Moreover, a timer unit 55 for measuring time is connected to the CPU 51. The CPU 51 performs various kinds of processing based on the time measured by the timer unit 55. Further, an operation unit 56 composed of a touch panel or ten-key for receiving instructions given by the user is connected to the CPU 51.

Additionally, the above-described detection sensor 21 and temperature and humidity sensor 22 are connected to the CPU 51. The detection results are inputted to the CPU 51 from the detection sensor 21 and the temperature and humidity sensor 22, and the CPU 51 performs processing based on the inputted detection results. In addition, a driving unit 50 such as a motor for driving the belt driving roller 71 is connected to the CPU 51. By controlling the operation of the driving unit 50, the CPU 51 moves the conveyance belt 7 and controls the conveyance of the recording paper. Moreover, the exposure units 11*a*, 11*b*, 11*c* and 11*d* are connected to the CPU 51. By controlling the timing of forming an electrostatic latent image on the photoconductor drum 13 by the exposure unit 11, the CPU 51 controls the timing of forming each color image. Further, an adjustment amount storing unit 54 for storing an adjustment amount for the timing of forming each color image is connected to the CPU 51.

The image forming apparatus of the present invention performs a color registration adjustment process under a predetermined condition, such as when the power is turned on, after a predetermined time has elapsed since the power was turned on, or when images have been formed on a predetermined number of sheets of recording paper. When the temperature and humidity sensor 22 detects a predetermined temperature and/or humidity, or when the temperature and humidity sensor 22 detects a change greater than a predetermined value in the temperature and/or humidity, the image forming apparatus performs the color registration adjustment process. When noticeable color misregistration is confirmed directly by the eyes of the user, or when an instruction to perform a color registration adjustment is received from the user or a service person through the operation unit 56 at the time of maintenance, the image forming apparatus performs the color registration adjustment process.

Figure 4:
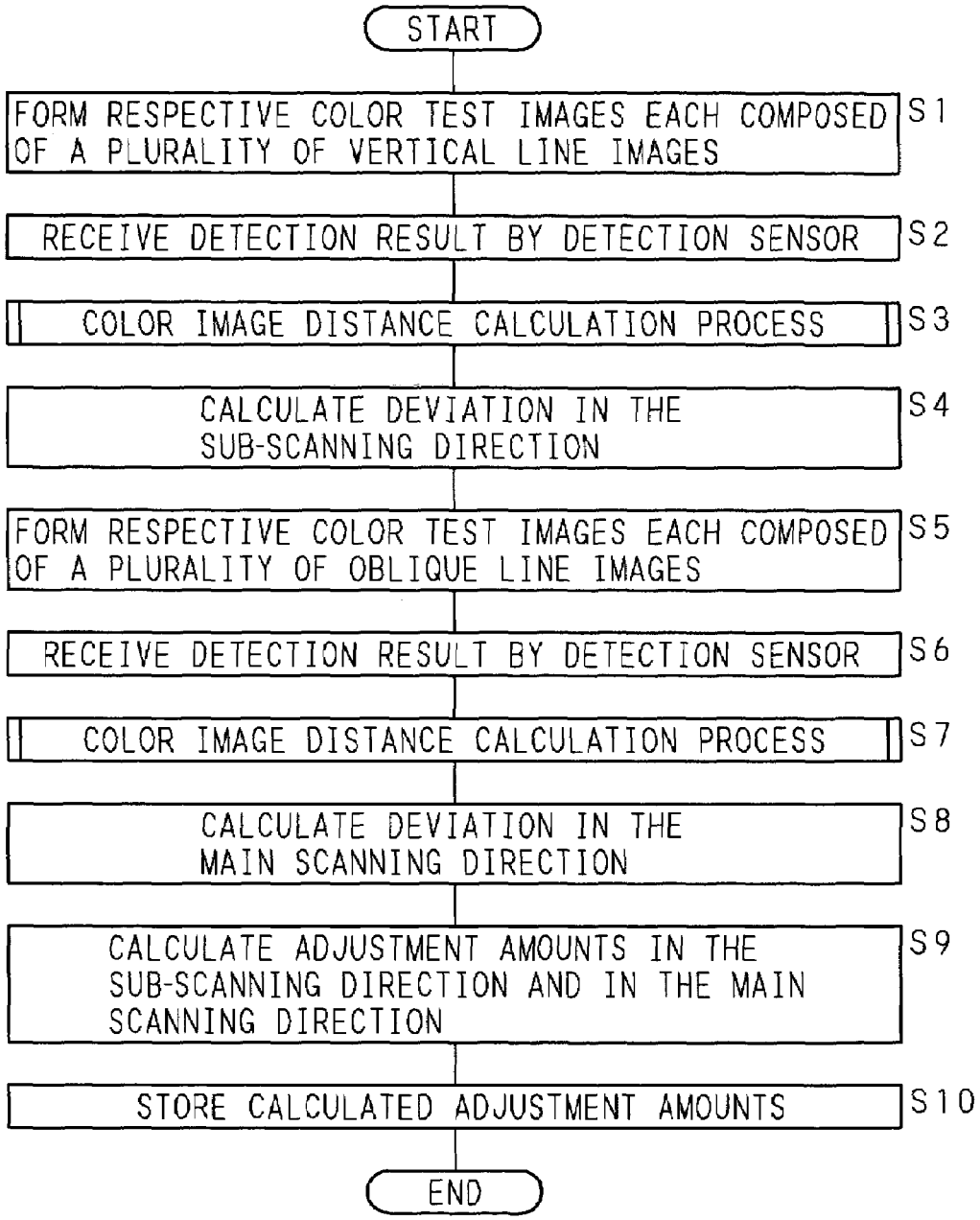
FIG. 4 is a flowchart showing the procedure of the color registration adjustment process performed by the image forming apparatus of the present invention.

FIG. 4 is a flowchart showing a procedure of the color registration adjustment process performed by the image forming apparatus of the present invention. According to the control program stored in the ROM 53, the CPU 51 performs the following color registration adjustment process shown in the flowchart of FIG. 4. Thus, the CPU 51 functions as a test image forming unit and an adjustment unit according to the present invention.

Figure 5:
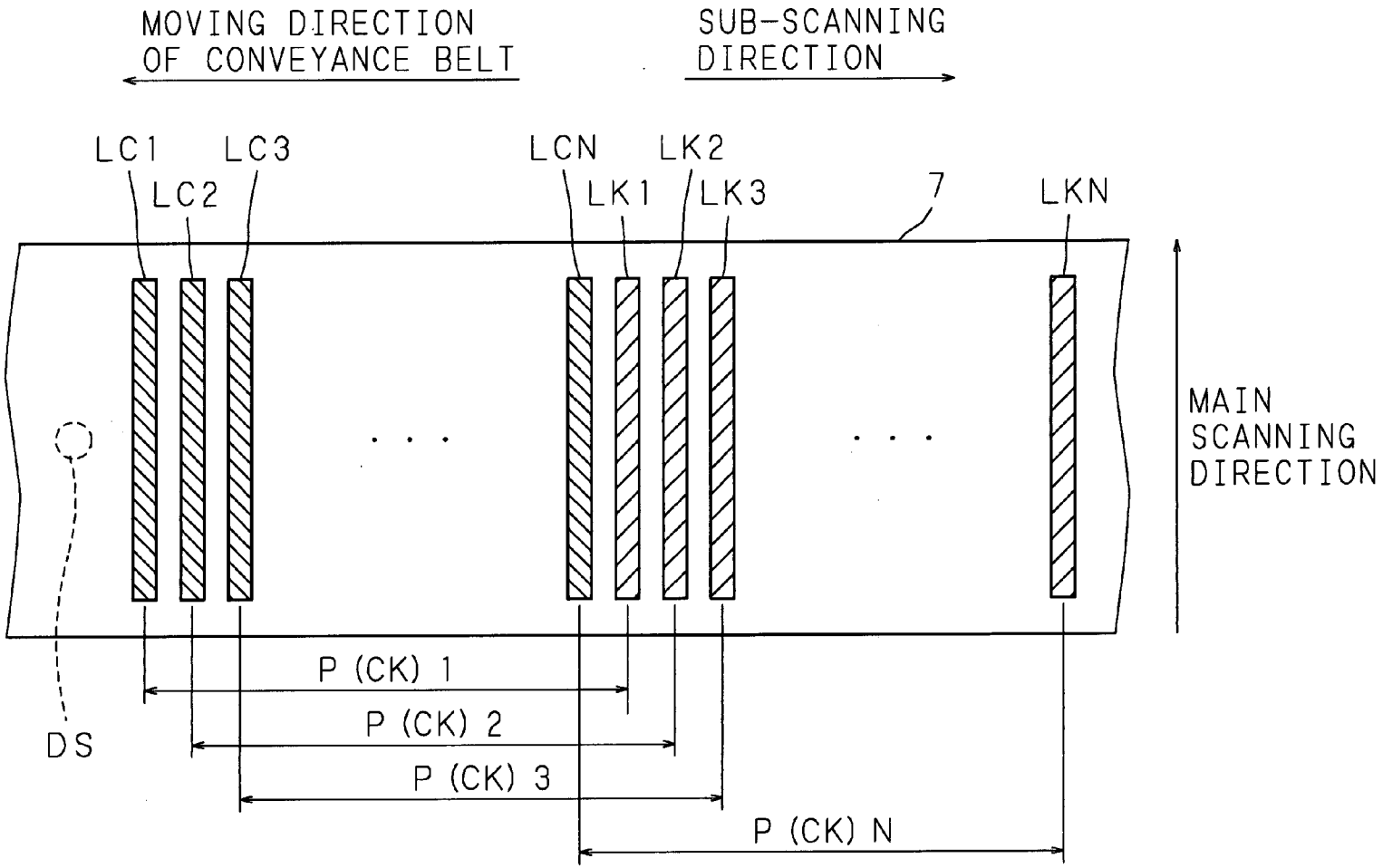
FIG. 5 is a schematic view showing color test images composed of vertical line images formed by the image forming apparatus of the present invention.

By controlling the exposure units 11*a*, 11*b*, 11*c* and 11*d*, the CPU 51 simultaneously forms the respective color test images of K, C, M, and Y, each composed of a plurality of vertical line images substantially orthogonal to the moving direction of the conveyance belt 7, directly on the conveyance belt 7 instead of recording paper (S1). When forming a color image on the recording paper, the respective color images of K, C, M, and Y are formed one after another, but if the respective color test images are simultaneously formed directly on the conveyance belt 7, the respective color test images are formed at positions on the conveyance belt 7 separated by distances according to the respective colors determined by the distance between the photoconductor drums 13, etc. based on the relative positional relationship of the respective color images formed. FIG. 5 is a schematic view showing color test images composed of vertical line images (LC1, LC2, LC3 . . . , LCN and LK1, LK2, LK3, . . . , LKN). The photoconductor drum 13*a* forms, on the conveyance belt 7, a K-color test image composed of vertical line images LK1, LK2, . . . , LKN that are black lines orthogonal to the moving direction of the conveyance belt 7. At the same time, the photoconductor drums 13*b*, 13*c* and 13*d* form, on the conveyance belt 7, color test images composed of N vertical line images of C-, M-, and Y-colors, respectively. A sub-scanning direction when forming an image on the recording paper is the reverse direction to the moving direction of the conveyance belt 7. Moreover, a direction orthogonal to the moving direction of the conveyance belt 7 is a main scanning direction when forming an image on the recording paper.

In FIG. 5, a detection spot DS for detecting each vertical line image by the detection sensor 21 is shown. In order to accurately detect a vertical line image by the detection sensor 21, the width of a vertical line image and the distances between vertical line images are preferably larger than the diameter of the detection spot DS. For example, if the diameter of the detection spot DS is 3 mm and the resolution of the image forming apparatus is 600 dpi, then the size of one pixel is about 42.3 μm and the width of 100 pixels is about 4.2 mm, and therefore it is preferable to form a vertical line image with the width of 100 pixels at intervals of 100 pixels. Moreover, in order to detect color misregistration caused by eccentricity or rotational irregularity of the photoconductor drums 13, the CPU 51 forms a number of color test images corresponding to at least one rotation of the photoconductor drum 13.

The test image formed on the conveyance belt 7 moves with the movement of the conveyance belt 7. The irradiating unit 24 of the detection sensor 21 irradiates light to the test image on the conveyance belt 7. Regular reflection light of the light irradiated by the irradiating unit 24 is detected by the regular reflection light detecting unit 25, while irregular reflection light is detected by the irregular reflection light detecting unit 26. Next, the CPU 51 receives the detection results of detecting the respective vertical line images by the detection sensor 21 (S2).

Figure 6A:
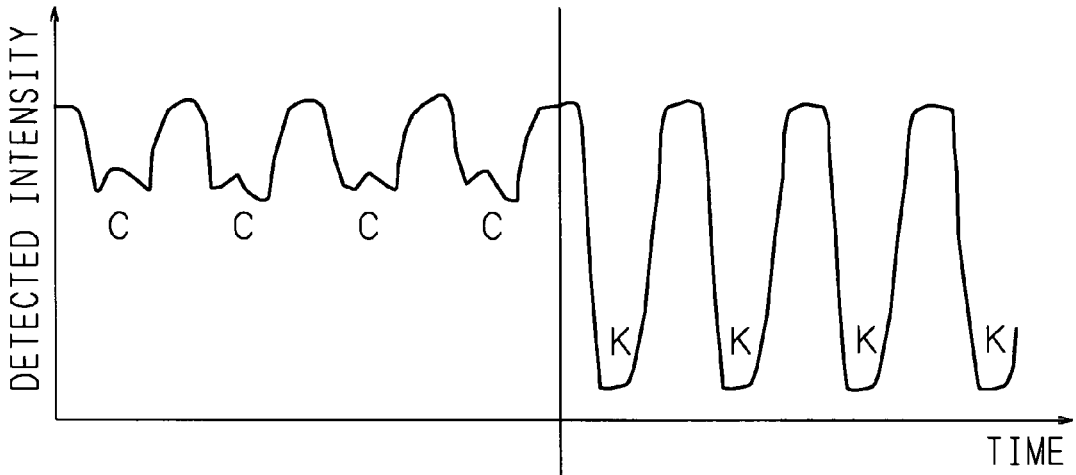
FIG. 6A and FIG. 6B are graphs showing examples of the characteristics of the detection results of the detection sensor of the image forming apparatus of the present invention.
Figure 6B:
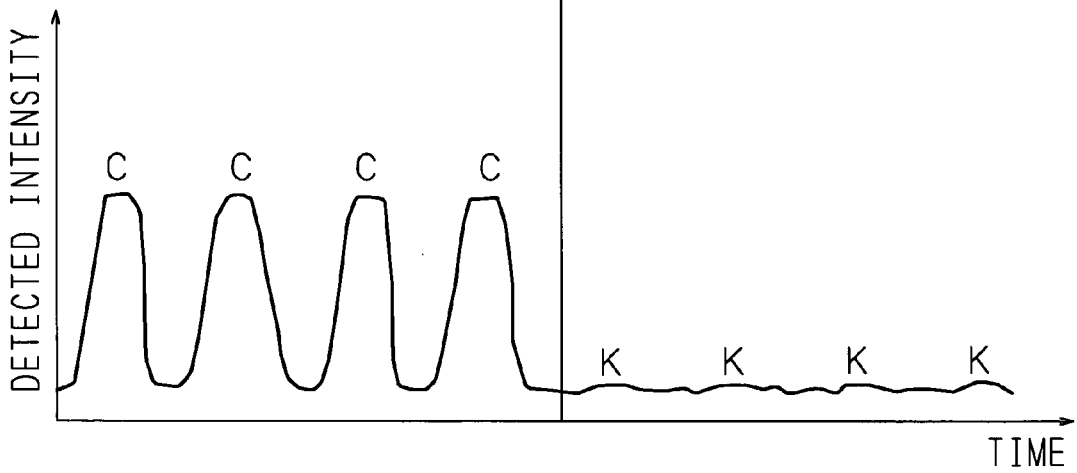

FIG. 6A and FIG. 6B are graphs showing examples of the characteristics of the detection results of the detection sensor 21. Note that FIG. 6A shows the characteristics of the detection results of the regular reflection light detecting unit 25, and FIG. 6B shows the characteristics of the detection results of the irregular reflection light detecting unit 26. The ordinate in FIG. 6A and FIG. 6B shows the detected intensity of reflection light, and the abscissa shows time. Moreover, K in FIG. 6A and FIG. 6B represents the detection results corresponding to the K-color image, and C represents the detection results corresponding to the C-color image.

There are differences in the light reflecting characteristics between the K-color image and the color images of C, M, and Y that are chromatic colors. More specifically, the quantity of regular reflection light from the K-color image is smaller than that of regular reflection light from the C, M, or Y-color image. Besides, the quantity of regular reflection light from a portion of the surface of the conveyance belt 7 where no image is formed is slightly larger than that of regular reflection light from the C, M, or Y-color image. Further, the quantity of irregular reflection light from the C, M, or Y-color image is slightly larger than that of irregular reflection light from the K-color image, or from the surface of the conveyance belt 7 where no image is formed. However, the quantities of regular reflection light and irregular reflection light vary depending on the surface condition of the conveyance belt 7. Hence, the quantities of regular reflection light and irregular reflection light from the conveyance belt 7 change according to a change in the surface condition with time, based on the operating time of the conveyance belt 7, or the number of sheets of recording paper on which images have been formed.

Therefore, as shown in FIG. 6A, in a portion corresponding to the K-color image, the detected intensity of regular reflection light is greatly decreased compared to a portion where no image is formed. On the other hand, in a portion corresponding to the C-color image, the detected intensity of regular reflection light is only slightly decreased. Moreover, since the regular reflection light detected by the regular reflection light detecting unit 25 includes irregular reflection light, the disturbance due to irregular reflection light is more noticeable in the detected intensity of regular reflection light from a portion corresponding to the C-color image. Besides, as shown in FIG. 6B, in a portion corresponding to the K-color image and a portion where no image is formed, the detected intensity of irregular reflection light is small, but in a portion corresponding to the C-color image, the detected intensity of irregular reflection light is increased.

Figure 7:
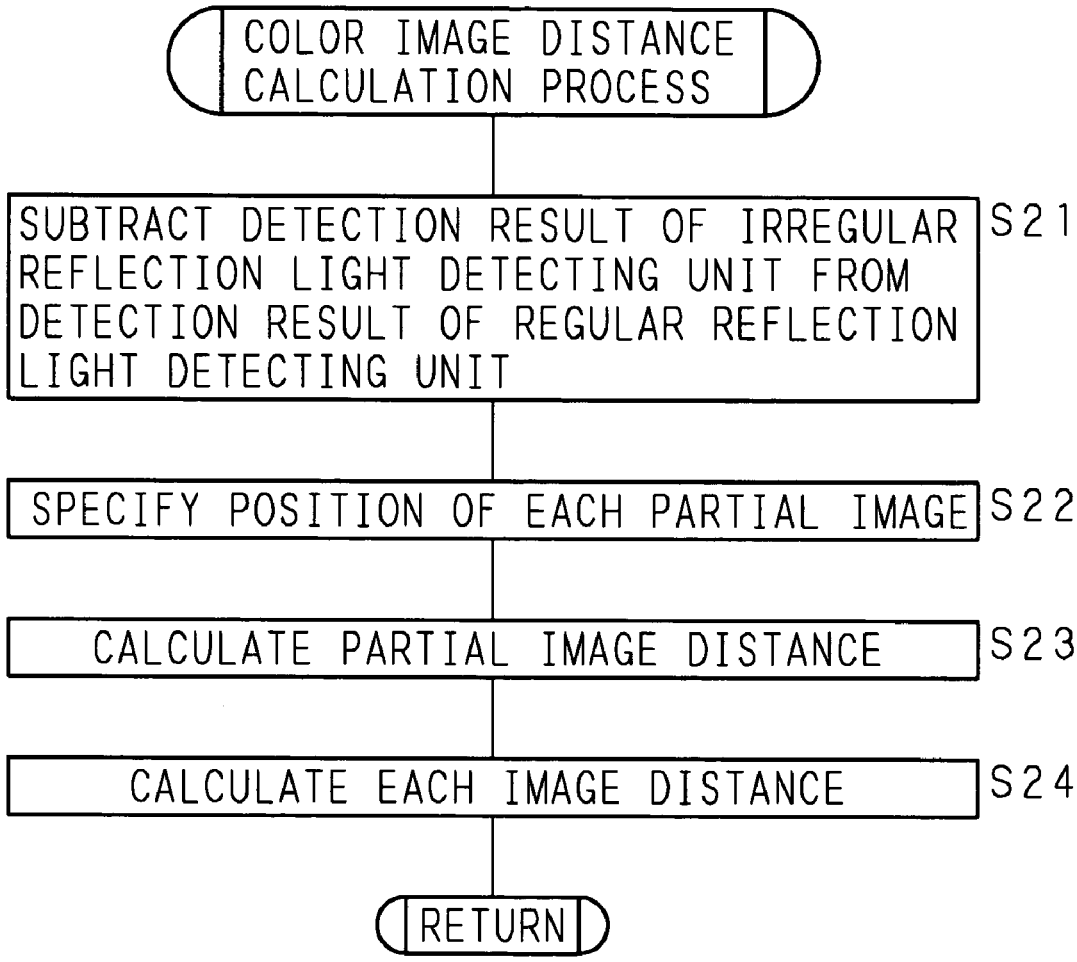
FIG. 7 is a flowchart showing the procedure of a process of a sub-routine of the color image distance calculation process of step S3 of the flowchart of FIG. 4.

Next, the CPU 51 performs a color image distance calculation process for calculating the distance between respective color test images of K, C, M, and Y formed on the conveyance belt 7 (S3). Accordingly, the CPU 51 functions as the color image distance calculating means. FIG. 7 is a flowchart showing the procedure of a process of a sub-routine of the color image distance calculation process of step S3. Referring to FIG. 7, the following description will explain the process of a sub-routine of the color image distance calculation process of step S3. The CPU 51 subtracts a detection result of the irregular reflection light detecting unit 26 from a detection result of the regular reflection light detecting unit 25 (S21).

Figure 8:
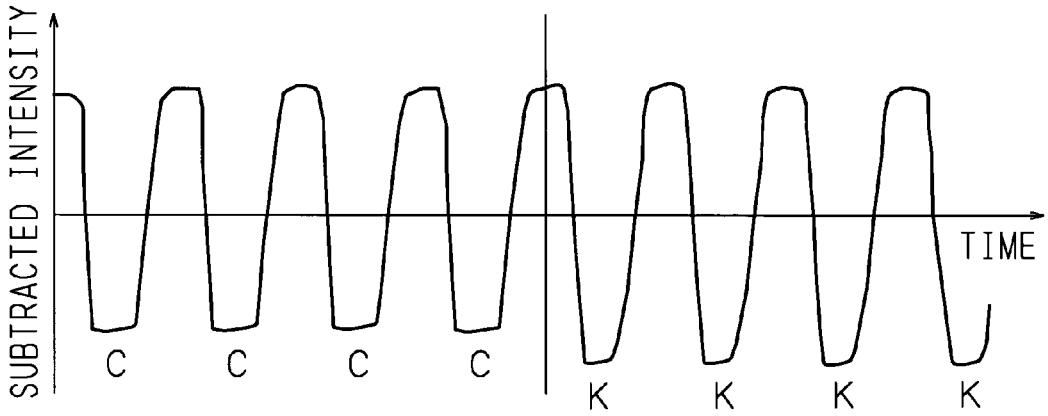
FIG. 8 is a graph showing an example of the characteristics of the subtraction result obtained by subtracting a detection result of an irregular reflection light detecting unit from a detection result of a regular reflection light detecting unit of the image forming apparatus of the present invention.

FIG. 8 is a graph showing an example of the characteristics of the subtraction results obtained by subtracting the detection result of the irregular reflection light detecting unit 26 from the detection result of the regular reflection light detecting unit 25. FIG. 8 shows an example of subtracting the detection result of the irregular reflection light detecting unit 26 shown in FIG. 6B from the detection result of the regular reflection light detecting unit 25 shown in FIG. 6A. The quantity of the detected intensity of irregular reflection light increases a lot for the C-color image but little for the K-color image compared to a portion where no image is formed. On the other hand, the quantity of the detected intensity of regular reflection light decreases little for the C-color image but a lot for the K-color image compared to a portion where no image is formed. Accordingly, by subtracting the detected intensity of irregular reflection light from the detected intensity of regular reflection light, it is possible to obtain a subtraction result indicating that the subtracted intensity for the portions corresponding to the C-color image and the K-color image is greatly decreased compared to a portion where no image is formed. By using this subtraction result, it is possible to easily recognize a portion corresponding to each vertical line image. Note that the light reflecting characteristics differ among the color images of C, M and Y. Therefore, for the portions of color images of C, M, and Y, a subtraction may be performed after multiplying the detection result of the irregular reflection light detecting unit 26 by a predetermined factor corresponding to each color, C, M or Y.

Next, the CPU 51 specifies the position of each vertical line image that is a partial image included in the respective color test images of K, C, M, and Y, based on a change in the subtraction result with time (S22). Accordingly, the CPU 51 functions as the partial image position specifying means. More specifically, the CPU 51 calculates the relative positions of vertical line images on the conveyance belt 7, based on the time at which a portion such as a rise, fall, or the center position of the decreased portion in the subtracted intensity calculated in step S21 was detected and the moving speed of the conveyance belt 7.

Next, the CPU 51 calculates a partial image distance that is the distance between mutually corresponding vertical line images included in the respective color test images, based on the relative positions of vertical line images on the conveyance belt 7 (S23). Accordingly, the CPU 51 functions as the partial image distance calculating means. More specifically, as shown in FIG. 5, the CPU 51 calculates a partial image distance P(CK)1 between the first vertical line image LC1 of C and the first vertical line image LK1 of K, and similarly calculates other partial image distances P(CK)2, P(CK) 3, . . . , P(CK)N. Moreover, the CPU 51 calculates N partial image distances between the K-color test image and each of the M-color test image and the Y-color test image in the same manner.

Next, the CPU 51 calculates a color image distance between the K-color test image and each of the color test images of C, M, and Y by finding an average value of N partial image distances between the K-color test image and each of the color test images of C, M, and Y (S24), and terminates the sub-routine of the color image distance calculation process of step S3 and returns the processing to the main routine.

Next, the CPU 51 calculates a deviation in the sub-scanning direction when recording the images on the recording paper, based on the color image distances calculated in the sub-routine of step S3 (S4). For example, when the color image distance between the K-color test image and the C-color test image is longer than a designed distance determined by a designed distance between the photoconductor drums 13*a* and 13*b* corresponding to the respective colors, if the respective color images are formed on the recording paper at timings predetermined based on the designed distance so that the respective color images are superimposed on each other, the C-color image is formed on the recording paper at a timing earlier than the timing at which it is superimposed on the K-color image, and consequently color misregistration occurs. Thus, by comparing the designed distance determined by the designed distance between the photoconductor drums 13 with the color image distance, the CPU 51 calculates a deviation of each of C-, M-, and Y-color images in the sub-scanning direction with respect to the K-color image when recording the images on the recording paper.

Figure 9:
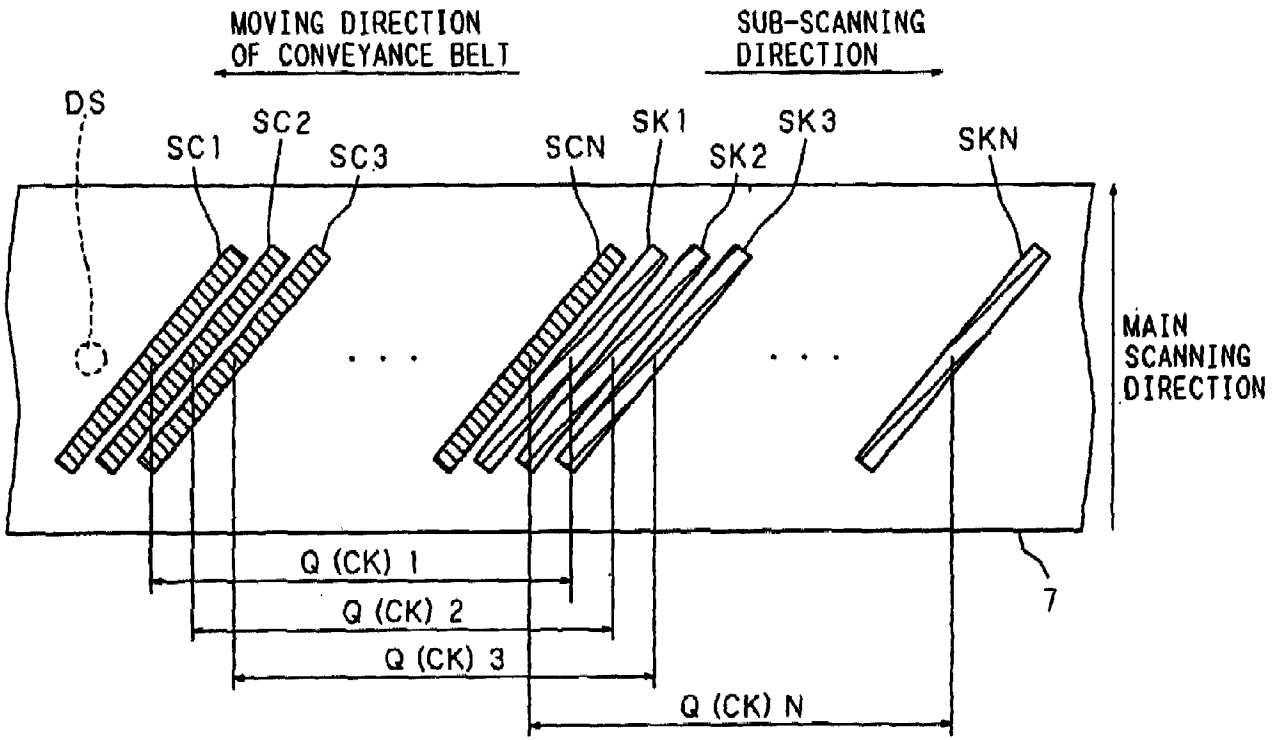
FIG. 9 is a schematic view showing color test images composed of oblique line images formed by the image forming apparatus of the present invention.

Next, by controlling the exposure units 11*a*, 11*b*, 11*c* and 11*d*, the CPU 51 simultaneously forms the respective color test images of K, C, M, and Y, each composed of a plurality of oblique line images oblique to the moving direction of the conveyance belt 7, directly on the conveyance belt 7, instead of the recording paper (S5). At this time, the CPU 51 forms oblique line images inclined at 45° with respect to the moving direction of the conveyance belt 7. FIG. 9 is a schematic view showing color test images composed of oblique line images (SC1, SC2, SC3, . . . , SCN and SK1, SK2, SK3, . . . , SKN). The photoconductor drum 13*a* forms, on the conveyance belt 7, a K-color test image composed of oblique line images SK1, SK2, . . . , SKN which are black lines oblique to the moving direction of the conveyance belt 7. At the same time, the photoconductor drums 13*b*, 13*c* and 13*d* form respective color test images, each composed of N lines of oblique line images of C, M or Y color, on the conveyance belt 7.

The irradiating unit 24 of the detection sensor 21 irradiates light to the test image on the conveyance belt 7. Regular reflection light of the light irradiated by the irradiating unit 24 is detected by the regular reflection light detecting unit 25, while irregular reflection light is detected by the irregular reflection light detecting unit 26. Next, the CPU 51 receives the detection results of detecting each of the oblique line images by the detection sensor 21 (S6). Next, the CPU 51 performs a color image distance calculation process for calculating the distance between the respective color test images of K, C, M, and Y formed on the conveyance belt 7 (S7). The content of the color image distance calculation process of step S7 is similar to the color image distance calculation process of step S3 that is a sub-routine shown in the flowchart of FIG. 7, and the CPU 51 calculates a color image distance based on the detection results of detecting each of the oblique line images by the detection sensor 21. That is, the CPU 51 calculates a partial image distance that is the distance between mutually corresponding oblique line images included in the respective color test images, based on the relative positions of the oblique line images on the conveyance belt 7 (S23). More specifically, as shown in FIG. 9, the CPU 51 calculates a partial image distance Q(CK)1 between the first obliciue line image SC1 of C and the first obliciue line image SK1 of K, and similarly calculates other partial image distances Q(CK)2, Q(CK) 3, . . . , Q(CK)N. Moreover, the CPU 51 calculates N partial image distances between the K-color test image and each of the M-color test image and the Y-color test image in the same manner.

Figure 10:
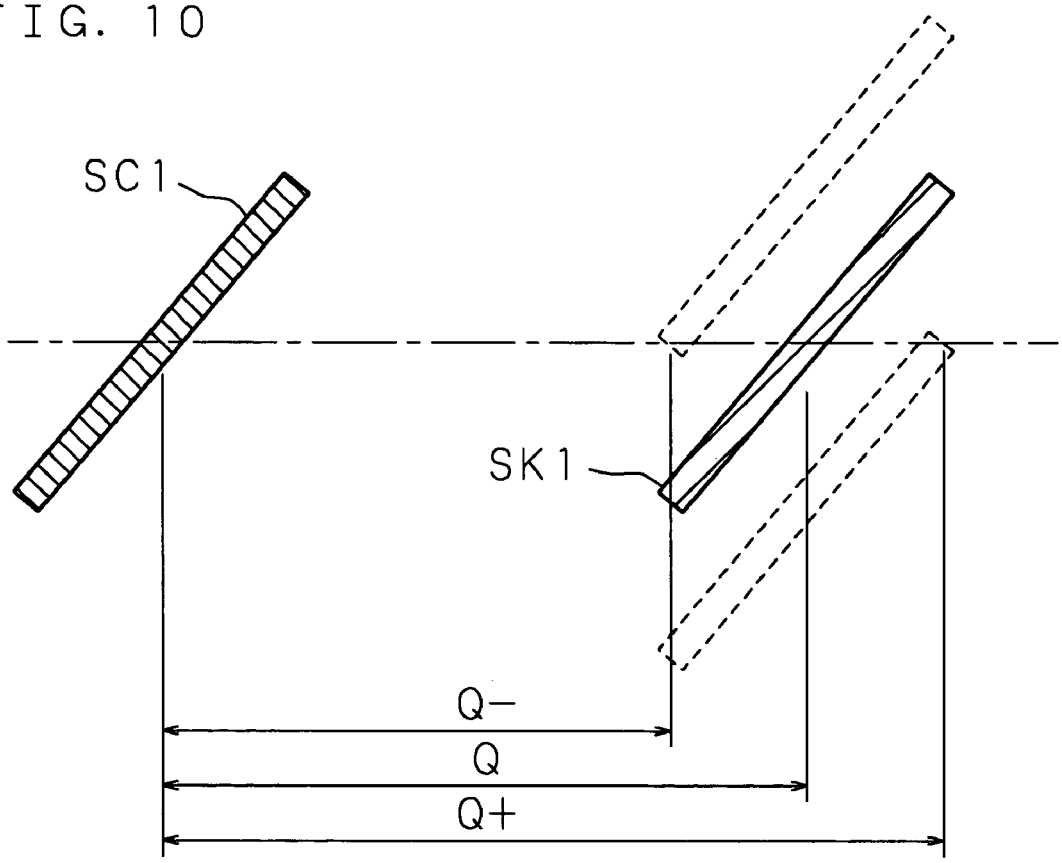
FIG. 10 is a concept view showing a method for calculating a deviation in a main scanning direction of the image forming apparatus of the present invention.

Next, the CPU 51 calculates a deviation of each color image in the main scanning direction when recording the image on the recording paper, based on the color image distances calculated in the sub-routine of step S7 (S8). FIG. 10 is a concept view showing a method for calculating a deviation in the main scanning direction. When there is no deviation in the main scanning direction, a distance Q between color images composed of oblique lines takes the same value as the distance between color images composed of vertical lines calculated in step S3. Moreover, when the K-color image is formed at an earlier timing in the main scanning direction compared to the C-color image, the position of the K oblique line image is displaced downwards in FIG. 10. In this case, the value of color image distance of oblique lines Q+ between C and K is greater than the color image distance of vertical lines calculated in step S3. On the other hand, when the K-color image is formed at a later timing in the main scanning direction compared to the C-color image, the position of the K oblique line image is displaced upwards in FIG. 10. In this case, the value of color image distance of oblique lines Q− between C and K is smaller than the color image distance of vertical lines calculated in step S3. Thus, by correcting the difference between the color image distance of vertical lines calculated in step S3 and the color image distance of oblique lines calculated in step S7 according to the inclination of the oblique line images, the CPU 51 can calculate a deviation of each color image in the main scanning direction when recording the image on the recording paper.

Note that the image forming apparatus of the present invention may be constructed to form oblique line images inclined in the reverse direction with respect to the oblique line images shown in FIG. 9 and FIG. 10 and perform the process of calculating a deviation in the main scanning direction according to the inclination, instead of the above-described structure.

Next, based on the amounts of color misregistration in the sub-scanning direction and the main scanning direction, the CPU 51 calculates adjustment amounts in the sub-scanning direction and the main scanning direction for adjusting the timings of forming color images by the exposure units 11*a*, 11*b*, 11*c* and 11*d* so that the color misregistration is corrected and the positions of the respective color images on the recording paper coincide with each other (S9). Accordingly, the CPU 51 functions as the adjustment amount calculating means. Next, the CPU 51 stores the calculated adjustment amounts in the adjustment amount storing unit 54 (S10), and terminates the processing. When forming the images on the recording paper, the CPU 51 adjusts the timings of causing the exposure units 11*a*, 11*b*, 11*c* and 11*d* to form the respective color images, based on the adjustment amounts for the sub-scanning direction and the main scanning direction stored in the adjustment amount storing unit 54, and causes them to form the images so that the respective color images are exactly superimposed.

As described in detail above, the image forming apparatus of the present invention forms a color test image of each color composed of a plurality of partial images arranged at predetermined intervals in the moving direction of the conveyance belt 7, at a position on the conveyance belt 7 separated by distances according to the respective colors from relative positions where the respective color images are formed, detects the position of each partial image by the detection sensor 21, calculates the distance between mutually corresponding partial images included in the respective color images, calculates the distance between the respective color test images by finding an average value of a plurality of partial image distances between the respective colors, and calculates an adjustment amount for adjusting a position of forming a color image on the medium so that the color images formed by the respective image forming units are exactly superimposed on each other.

Since the method for calculating the distance between respective color test images by detecting color test images separated from each other is a simple method compared to a method in which color test images are formed one upon another and the superimposed state is measured, it is possible to reduce the time taken for the color registration adjustment without narrowing the region capable of adjusting the positions of the respective color images. Moreover, in order to find the distance between the separated color test images, there is no need to form the respective color test images one upon another and it is sufficient to form the respective color test images with a minimum amount of developer, and therefore it is possible to reduce the cost of the color registration adjustment without narrowing the region capable of adjusting the positions of the respective color images. Further, by finding the distance between the respective color test images by using a plurality of partial image distances, it is possible to calculate an adjustment amount for adjusting a position of accurately forming a color image on the medium.

Additionally, in the present invention, a detection result of the irregular reflection light detecting unit 26 is subtracted from a detection result of the regular reflection light detecting unit 25, and the position of each partial image is specified based on this result. When a K-color image is detected, the detection result of regular reflection light changes significantly, while when each of C-, M-, and Y-color images is detected, the detection result of irregular reflection light changes significantly, and therefore it is possible to accurately specify the position of each partial image, based on a change in the value of difference between the detection result of regular reflection light and the detection result of irregular reflection light. Further, by subtracting the detection result of irregular reflection light from the detection result of regular reflection light, it is possible to remove the disturbance in the detection result of regular reflection light caused by the irregular reflection light mixed with the regular reflection light. Consequently, even when a low-resolution detection sensor 21 is used, it is possible to calculate an adjustment amount for adjusting a position of accurately forming a color image on the medium.

Moreover, in the present invention, vertical line images are formed as partial images, the distance between color images of vertical lines is calculated between the respective colors, and based on this result, an adjustment amount in the sub-scanning direction to adjust the position of forming a color image on the medium can be easily calculated. Further in the present invention, oblique line images are formed as partial images, the distance between color images of oblique lines is calculated between respective colors, and based on this result, an adjustment amount in the main scanning direction to adjust the position of forming a color image on the medium can be easily calculated.

Note that although this embodiment illustrates a mode in which the process of calculating a deviation in the sub-scanning direction by forming vertical line images and the process of calculating a deviation in the main scanning direction by forming oblique line images are performed individually, the present invention is not limited to this, and it may be possible to implement a mode in which the deviations in-the sub-scanning direction and the main scanning direction are calculated by a single process of forming color test images composed of vertical line images and oblique line images on the conveyance belt 7. Alternatively, it may be possible to implement a mode in which partial images of a form other than vertical line images or oblique line images are formed.

Besides, although this embodiment illustrates a mode in which the exposure units 11*a*, 11*b*, 11*c* and 11*d* simultaneously form the respective color test images on the conveyance belt 7, it may be possible to implement a mode in which each test image is formed at a position on the conveyance belt 7 separated by distances according to the respective colors from relative positions where the respective color images are formed by other method, such as forming the respective color test images of K, C, M, and Y at mutually different timings. Moreover, although this embodiment illustrates a mode in which the test images are formed on the conveyance belt 7, it may be possible to implement a mode in which the test images are formed on the recording paper conveyed by the conveyance belt 7.

Further, in this embodiment, although the image forming apparatus of the present invention is a direct transfer type image forming apparatus for directly transferring an image to the recording paper, it is not limited to this, and may be an intermediate transfer type image forming apparatus that forms a multi-color image by forming respective color images one upon another on a transfer belt and collectively transferring the superimposed respective color images to the recording paper from the transfer belt. In this case, it is possible to perform similar processing by forming test images on the transfer belt.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising: a plurality of image forming means for forming color images of mutually different colors on a medium which is moving in a predetermined direction; test image forming means for causing each of said plurality of image forming means to form a test image on said medium; irradiating means for irradiating light to the test image formed on said medium; detecting means for detecting regular reflection light and irregular reflection light of the light irradiated to the test image by said irradiating means; and adjusting means for adjusting, based on detection results of said detecting means, a position of forming a color image on said medium by each of said image forming means so that the color images formed by said respective image forming means are exactly superimposed on each other, wherein said test image forming means causes each of said image forming means to form a color test image composed of a plurality of partial images arranged at predetermined intervals in the moving direction of said medium, at a position on said medium separated from relative positions on said medium where the respective color images are formed by distances according to the respective colors, and said adjusting means includes:

partial image distance calculating means for calculating, based on detection results of said detecting means, a partial image distance that is a distance between mutually corresponding partial images in the respective color test images formed on said medium;

color image distance calculating means for calculating, based on the calculation result of said partial image distance calculating means, a color image distance that is a distance between the respective color test images formed on said medium; and adjustment amount calculating means for calculating, based on the color image distance calculated by said color image distance calculating means, an adjustment amount for adjusting a position of forming a color image on said medium by each of said image forming means so that the color images formed by said respective color image forming means are exactly superimposed on each other.

2. The image forming apparatus as set forth in claim 1, wherein said test image forming means includes means for causing each of said image forming means to form vertical line images that are line images substantially orthogonal to the moving direction of said medium as said partial images, and said adjustment amount calculating means includes means for calculating, based on the color image distance when said partial images are the vertical line images, an adjustment amount for adjusting a position of forming a color image on said medium by each of said image forming means in the moving direction of said medium.

3. The image forming apparatus as set forth in claim 2, wherein said test image forming means further includes means for causing each of said image forming means to form oblique line images that are line images oblique to the moving direction of said medium as said partial images, and said adjustment amount calculating means further includes means for calculating, based on the color image distance when said partial images are the oblique line images and the vertical line images, an adjustment amount for adjusting a position of forming a color image on said medium by each of said image forming means in a direction substantially orthogonal to the moving direction of said medium.

4. The image forming apparatus as set forth in claim 1, wherein said detecting means includes: regular reflection light detecting means for detecting regular reflection light including irregular reflection light; and irregular reflection light detecting means for detecting irregular reflection light, said adjusting means includes: means for calculating a difference between a detection result detected by said regular reflection light detecting means and a detection result detected by said irregular reflection light detecting means; and partial image position specifying means for specifying a position of each partial image included in each color test image formed on said medium, based on a change in the difference value calculated by said means for calculating a difference, and said partial image distance calculating means calculates said partial image distance, based on the positions of the partial images specified by said partial image position specifying means.

5. The image forming apparatus as set forth in claim 4, wherein said regular reflection light detecting means and said irregular reflection light detecting means are constructed as one unit.

6. The image forming apparatus as set forth in claim 4, wherein said test image forming means includes means for causing each of said image forming means to form vertical line images that are line images substantially orthogonal to the moving direction of said medium as said partial images, and said adjustment amount calculating means includes means for calculating, based on the color image distance when said partial images are the vertical line images, an adjustment amount for adjusting a position of forming a color image on said medium by each of said image forming means in the moving direction of said medium.

7. The image forming apparatus as set forth in claim 6, wherein said test image forming means further includes means for causing each of said image forming means to form oblique line images that are line images oblique to the moving direction of said medium as said partial images, and said adjustment amount calculating means further includes means for calculating, based on the color image distance when said partial images are the oblique line images and the vertical line images, an adjustment amount for adjusting a position of forming a color image on said medium by each of said image forming means in a direction substantially orthogonal to the moving direction of said medium.

8. An image forming apparatus comprising: a plurality of image forming units for forming color images of mutually different colors on a medium which is moving in a predetermined direction; a control unit for causing each of said plurality of image forming units to form a test image on said medium; an irradiating unit for irradiating light to the test image formed on said medium; and a detecting unit for detecting regular reflection light and irregular reflection light of the light irradiated to the test image by said irradiating unit, wherein said control unit is capable of performing following operations of:

adjusting, based on detection results of said detecting unit, a position of forming a color image on said medium by each of said image forming units so that the color images formed by the respective image forming units are exactly superimposed on each other;

causing each of said image forming units to form a color test image composed of a plurality of partial images arranged at predetermined intervals in the moving direction of said medium, at a position on said medium separated from relative positions on said medium where the respective color images are formed by distances according to the respective colors;

calculating, based on detection results of said detecting unit, a partial image distance that is a distance between mutually corresponding partial images in the respective color test images formed on said medium;

calculating, based on the calculated partial image distances, a color image distance that is a distance between the respective color test images formed on said medium; and calculating, based on the calculated color image distance, an adjustment amount for adjusting a position of forming a color image on said medium by each of said image forming units so that the color images formed by said respective image forming units are exactly superimposed on each other.

9. The image forming apparatus as set forth in claim 8, wherein said control unit is further capable of performing following operations of:

causing each of said image forming units to form vertical line images that are line images substantially orthogonal to the moving direction of said medium as said partial images; and calculating, based on the color image distance when said partial images are the vertical line images, an adjustment amount for adjusting a position of forming a color image on said medium by each of said image forming units in the moving direction of said medium.

10. The image forming apparatus as set forth in claim 9, wherein said control unit is further capable of performing following operations of:

causing each of said image forming units to form oblique line images that are line images oblique to the moving direction of said medium as said partial images, and calculating, based on the color image distance when said partial images are the oblique line images and the vertical line images, an adjustment amount for adjusting a position of forming a color image on said medium by each of said image forming units in a direction substantially orthogonal to the moving direction of said medium.

11. The image forming apparatus as set forth in claim 8, wherein said detecting unit includes: a regular reflection light detecting unit for detecting regular reflection light including irregular reflection light; and an irregular reflection light detecting unit for detecting irregular reflection light; and said control unit is further capable of performing following operations of:

calculating a difference between a detection result detected by said regular reflection light detecting unit and a detection result detected by said irregular reflection light detecting unit;

specifying a position of each partial image included in each color test image formed on said medium, based on a change in the calculated difference value; and calculating the partial image distance, based on the specified positions of said partial images.

12. The image forming apparatus as set forth in claim 11, wherein said regular reflection light detecting unit and said irregular reflection light detecting unit are constructed as one unit.

13. The image forming apparatus as set forth in claim 11, wherein said control unit is further capable of performing following operations of:

causing each of said image forming units to form vertical line images that are line images substantially orthogonal to the moving direction of said medium as said partial images; and calculating, based on the color image distance when said partial images are the vertical line images, an adjustment amount for adjusting a position of forming a color image on said medium by each of said image forming units in the moving direction of said medium.

14. The image forming apparatus as set forth in claim 13, wherein said control unit is further capable of performing following operations of:

causing each of said image forming units to form oblique line images that are line images oblique to the moving direction of said medium as said partial images, and calculating, based on the color image distance when said partial images are the oblique line images and the vertical line images, an adjustment amount for adjusting a position of forming a color image on said medium by each of said image forming units in a direction substantially orthogonal to the moving direction of said medium.

15. A method for adjusting an image forming apparatus which includes: a plurality of image forming means for forming color images of mutually different colors on a medium being moving in a predetermined direction; test image forming means for causing each of said plurality of image forming means to form a test image on said medium; irradiating means for irradiating light to the test image formed on said medium; and detecting means for detecting regular reflection light and irregular reflection light of the light irradiated to the test image by said irradiating means so that the color images formed by said respective image forming means are exactly superimposed on each other, said method comprising the steps of:

causing each of said image forming means, by controlling of said test image forming means, to form a color test image composed of a plurality of partial images arranged at predetermined intervals in the moving direction of said medium, at a position on said medium separated from relative positions on said medium where the respective color images are formed by distances according to the respective colors;

calculating, based on detection results of said detecting means, a partial image distance that is a distance between mutually corresponding partial images in the respective color test images formed on said medium;

calculating, based on the calculated partial image distances, a color image distance that is a distance between the respective color test images formed on said medium; and calculating, based on the calculated color image distance, an adjustment amount for adjusting a position of forming a color image on said medium by each of said image forming means so that the color images formed by said respective color image forming means are exactly superimposed on each other.

* * * * *